US006997009B2

(12) United States Patent
Martens

(10) Patent No.: US 6,997,009 B2
(45) Date of Patent: Feb. 14, 2006

(54) VENTILATION ELEMENT FOR A COOLER

(75) Inventor: Ralf Martens, Beckum (DE)

(73) Assignee: Polysius AG, Beckum (DE)

( * ) Notice: Subject to any disclaimer, the term of this patent is extended or adjusted under 35 U.S.C. 154(b) by 172 days.

(21) Appl. No.: 10/770,114

(22) Filed: Feb. 2, 2004

(65) Prior Publication Data

US 2004/0168340 A1 Sep. 2, 2004

(30) Foreign Application Priority Data

Feb. 7, 2003 (DE) ..... 103 05 113

(51) Int. Cl.
*F25D 17/04* (2006.01)

(52) U.S. Cl. ..... 62/407

(58) Field of Classification Search ..... 62/406, 62/407, 411

See application file for complete search history.

(56) References Cited

U.S. PATENT DOCUMENTS 4,562,016 A * 12/1985 Colliver ..... 261/106
5,184,476 A * 2/1993 Desrosiers et al. ..... 62/389
5,996,366 A * 12/1999 Renard ..... 62/256
6,099,285 A * 8/2000 Kurihara et al. ..... 425/144
6,344,630 B1 * 2/2002 Jarvis et al. ..... 219/386

FOREIGN PATENT DOCUMENTS

DE 101 33 973 A1 2/2003

* cited by examiner

*Primary Examiner*—Melvin Jones

(74) *Attorney, Agent, or Firm*—John K. McCulloch

(57) ABSTRACT

Ventilation element for a cooler for cooling bulk material, comprising a tray-like component provided with at least one opening for the supply of cooling gas as well as an insert which can be releasably fixed in the tray-like component and forms a support surface which can be ventilated from below for the bulk material, the insert consisting of a plurality of longitudinal profiled sections and connecting elements disposed transversely with respect thereto. The longitudinal profiled sections and the connecting elements are constructed in such a way that they can be pushed into one another during assembly of the insert.

8 Claims, 4 Drawing Sheets

VENTILATION ELEMENT FOR A COOLER

The invention relates to a ventilation element for a cooler for cooling bulk material comprising a tray-like component provided with at least one opening for the supply of cooling gas as well as an insert which can be releasably fixed in the tray-like component and forms a support surface which can be ventilated from below for the bulk material, the insert consisting of a plurality of longitudinal profiled sections and connecting elements disposed transversely with respect thereto.

In a cooler which is provided for example for cooling cement clinker, a plurality of such ventilation elements are disposed adjacent to and behind one another. During the assembly of the individual ventilation elements the individual parts are position with the aid of clamping devices and are welded to one another.

In order to reduce the assembly costs, a ventilation element is known in the art in which the tray-like component is provided with two longitudinal grooves into which cast fins are pushed, the fins forming the support surface which can be ventilated for the bulk material. Finally an end closure plate is screwed on. Even if the assembly costs can be markedly reduced in this solution, this variant has the disadvantage that subsequent replacement of individual worn fins is no longer possible because these become jammed in the longitudinal grooves of the tray-like component due to the evolution of heat.

The object of the invention, therefore, is to provide a ventilation element for a cooler which is distinguished by low assembly costs and problem-free replacement of the insert.

According to the invention this object is achieved by the features of claim 1.

The ventilation element according to the invention for a cooler for cooling bulk material consists fundamentally of a tray-like component provided with at least one opening for the supply of cooling gas as well an insert which can be releasably fixed in the tray-like component and forms a support surface which can be ventilated from below for the bulk material, the insert consisting of a plurality of longitudinal profiled sections and connecting elements disposed transversely with respect thereto. In this case the longitudinal profiled sections and the connecting elements are constructed in such a way that they can be pushed into one another during assembly of the insert.

Further embodiments are the subject matter of the subordinate claims.

According to a preferred embodiment, the individual elements of the insert are merely pushed in during assembly and the insert is then releasably connected to the tray-like component. For connection of the insert to the tray-like component a connection by friction and by positive locking is preferably provided, whereby a defined bending moment is produced which results in precise securing of the position of the insert in the tray-like component and of the individual parts of the insert relative to one another.

According to a preferred embodiment, at least some of the longitudinal profiled sections are constructed as U-shaped sections and are disposed in such a way that a U-shaped section which is open at the top alternates with a U-shaped section which is open at the bottom, so that the flanks of adjacent U-shaped sections engage in one another and form a ventilation slot between them.

Further advantages and embodiments of the invention are explained in greater detail below with reference to the description and the drawings, in which.

Figure 1:
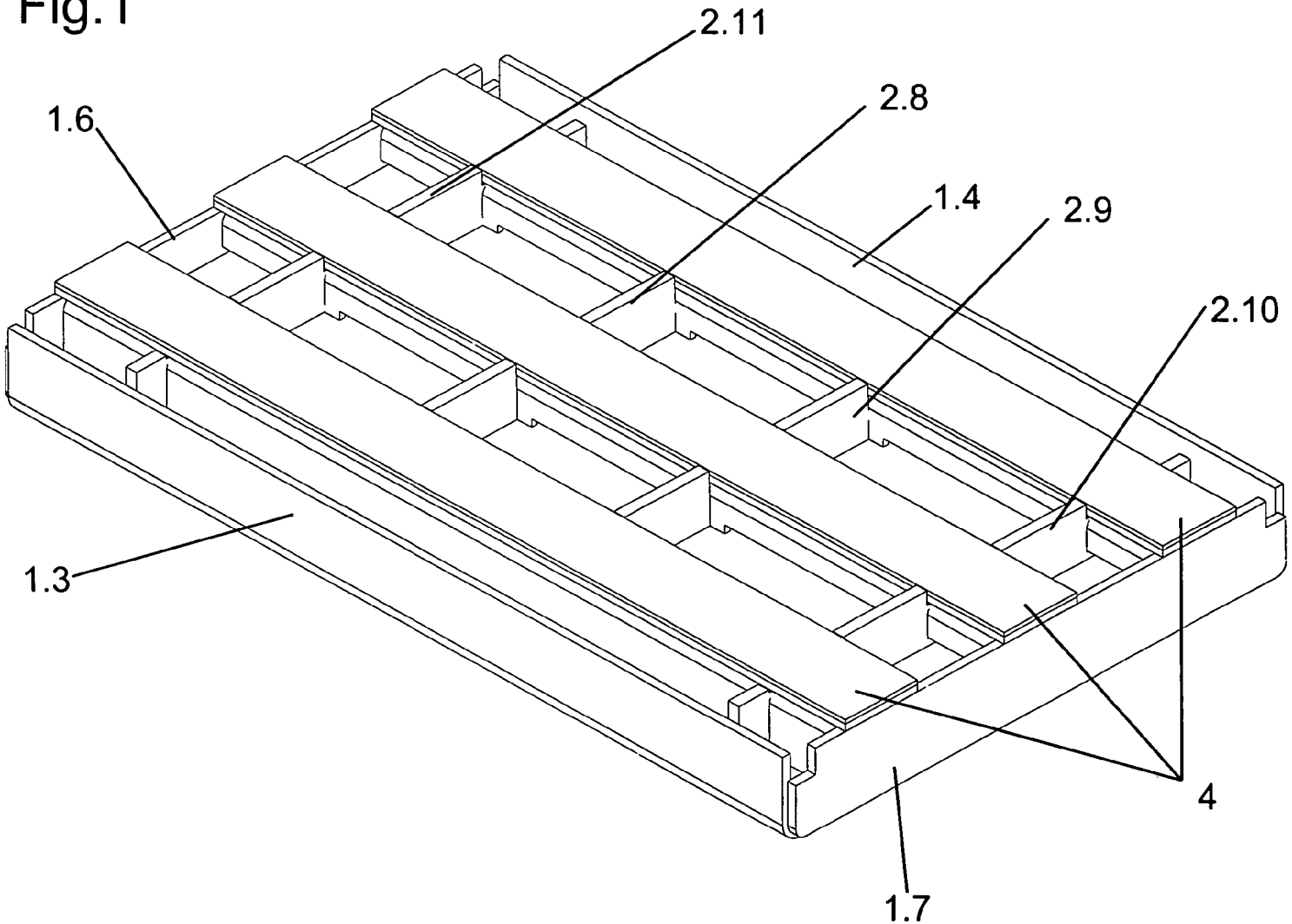
FIG. 1 shows a three-dimensional representation of the ventilation element.
Figure 2:
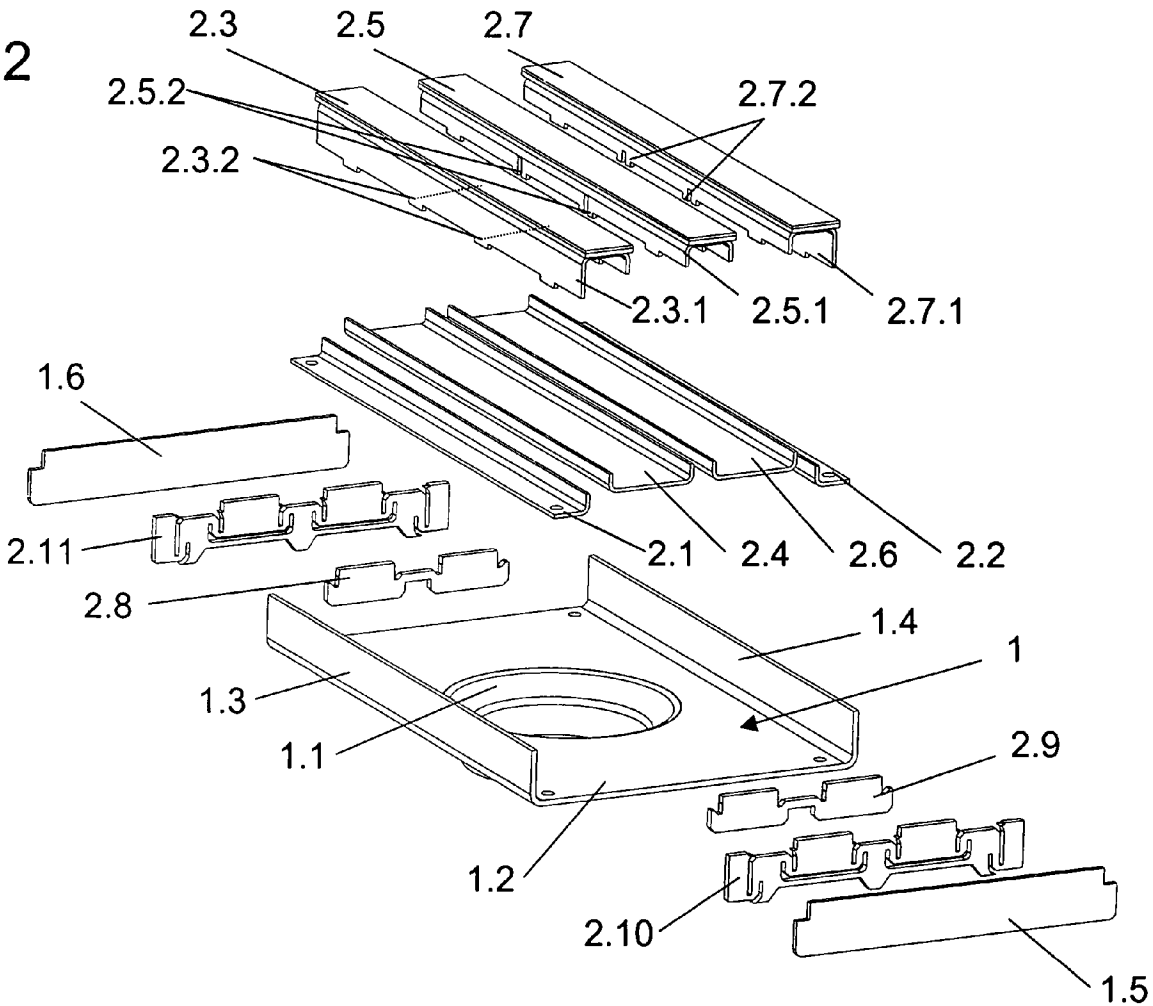
FIG. 2 shows an exploded view of the ventilation element.

The ventilation element shown in the drawings for a cooler for cooling bulk material consists fundamentally of a tray-like component 1 and an insert which can be releasably fixed in the tray-like component. The tray-like component has at least one opening 1.1 for the supply of cooling gas which is connected to a ventilation system.

The tray-like component further consists of a base part 1.2, two side walls 1.3 and 1.4 integrally connected to the base part and two end plates 1.5 and 1.6.

The insert 2 has longitudinal profiled sections 2.1–2.7 as well as connecting elements 2.8–2.11.

Some of the longitudinal profiled sections, namely the longitudinal profiled sections 2.3–2.7 are constructed as U-shaped sections and are disposed in such a way that a U-shaped section 2.4, 2.6 which is open at the top alternates with a U-shaped section 2.3, 2.5, 2.7 which is open at the bottom. In this case the flanks of adjacent U-shaped sections engage in one another and form a ventilation slot between them. The U-shaped sections 2.3, 2.5, 2.7 which are open at the bottom are supported on the U-shaped sections 2.4, 2.6 which are open at the top or on the L-shaped longitudinal profiled sections 2.1 and 2.2.

For this purpose the sections 2.3, 2.5 and 2.7 which are open at the bottom have on their flanks spaced projections 3.1, 2.5.1 and 2.7.1 which rest on the longitudinal profiled sections 2.1, 2.4, 2.6 or respectively 2.2. The ventilation slots 3 are formed between the projections.

Figure 5:
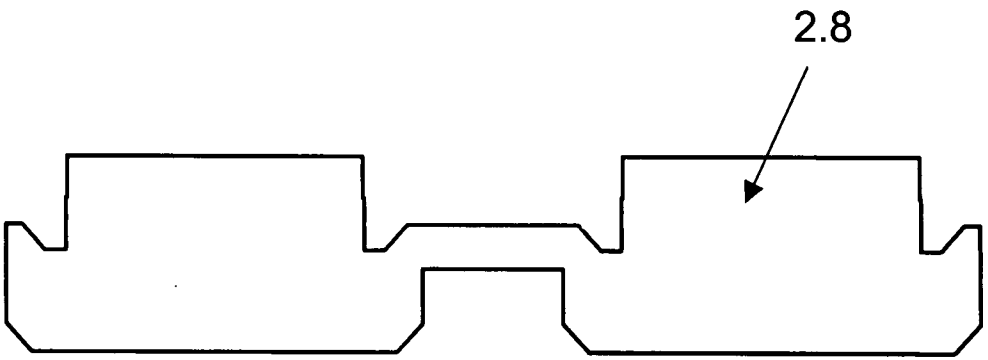
FIG. 5 shows a top view of a middle connecting element.
Figure 6:
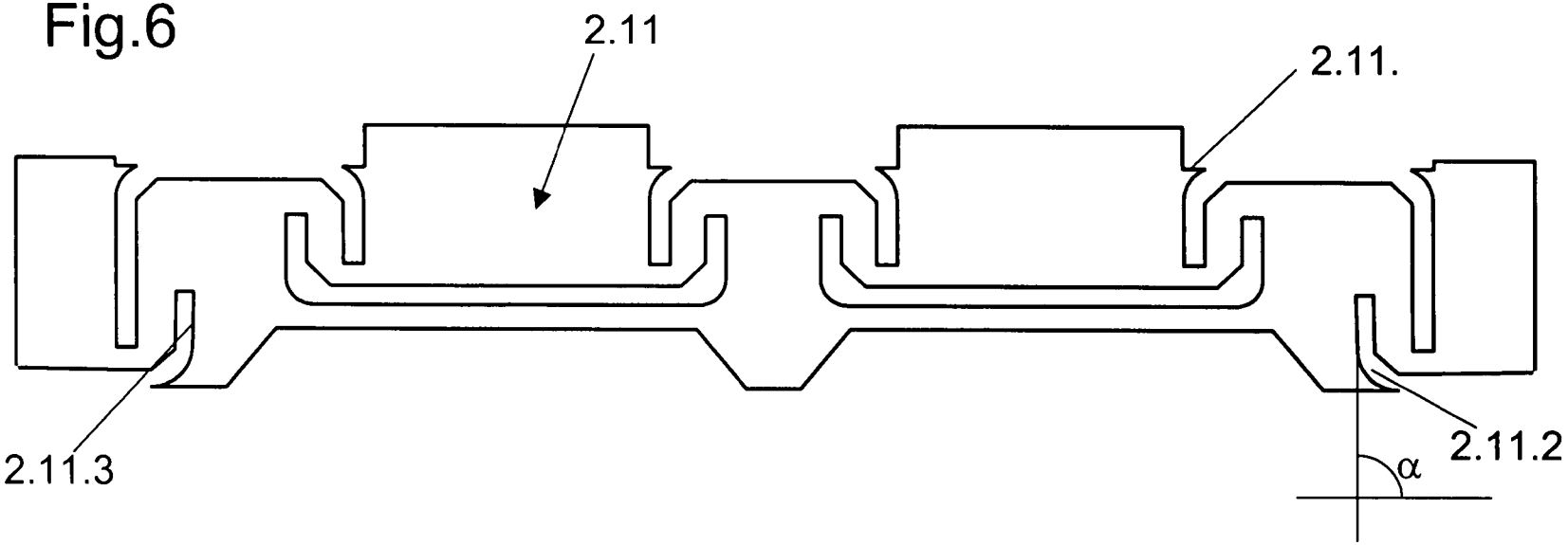
FIG. 6 shows a top view of an end connecting element.

The precise positioning of the longitudinal profiled sections is ensured by the connecting elements 2.8–2.11. FIG. 5 shows one of the two middle connecting elements 2.8, 2.9 and FIG. 6 shows one of the two end connecting elements 2.10, 2.11. During the assembly of the two middle connecting elements 2.8 and 2.9 these elements are pushed into the two U-shaped sections 2.4 und 2.8 which are open at the top, as can be seen in particularly from FIG. 4. Following this, the U-shaped sections 2.3, 2.5 and 2.7 are pushed on from above. These U-shaped sections are provided in the region of the two middle connecting elements 2.8 and 2.9 with slots 2.3.2, 2.5.2 and 2.7.2, so that the two middle connecting elements 2.8 and 2.9 are fixed in their position relative to the longitudinal profiled sections 2.3, 2.5 and 2.7. Following this, the two end connecting elements 2.10 und 2.11 can be pushed onto the U-shaped sections. In this case the end connecting elements are provided with corresponding cutouts (see FIG. 6).

Figure 4:
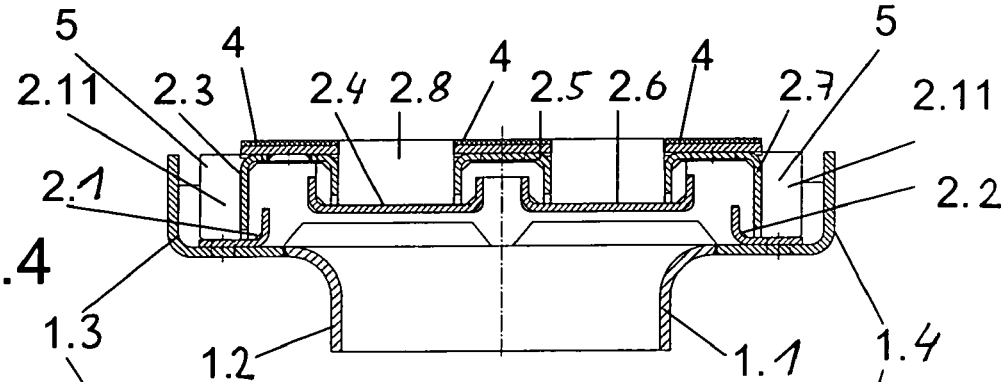
FIG. 4 shows a sectional view along the line IV—IV in FIG. 3.
Figure 3:
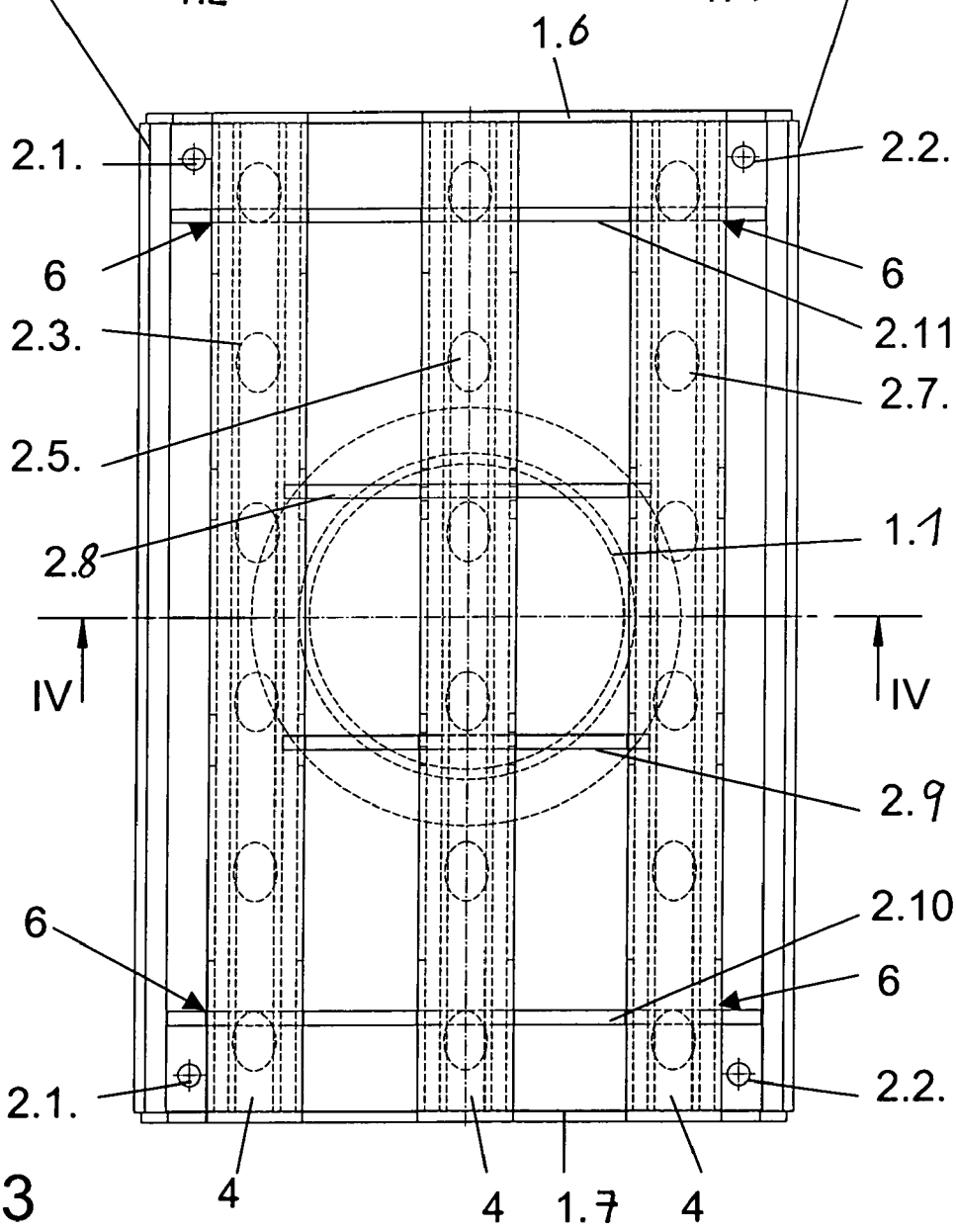
FIG. 3 shows a top view of the ventilation element.

The upwardly-directed faces of the U-shaped sections 2.3, 2.5 and 2.7 are each provided, according to their use, with special wear protection elements 4, the U-shaped section being provided in this region with openings 2.3.3, 2.5.3, 2.7.3, as can be seen in particular from FIGS. 3 and 4. These openings enable direct cooling of the wear protection elements 4. The wear protection elements 4 are fixed on the U-shaped sections for example by welding in the region of these openings.

As can be seen in particular in FIG. 4, due to the rounded corners of the U-shaped sections and the straight wear plates 4 so-called interstices 5 are formed in the transition region.

For this purpose the end connecting elements 2.11 have lugs 2.11.1 of complementary construction.

The insert 2 preferably consists of shaped sheet metal sections. The grooves and recesses in the connecting elements 2.8–2.11 are of such dimensions that the individual parts can be pushed on and joined together simply and with as little play as possible. Before the assembled insert is joined to the tray-like component 1 the individual parts of the insert are somewhat movable relative to one another depending upon the tolerances. Since this movability is undesirable in the completed insert, the insert is connected to the tray-like component 1 by friction and by positive locking as described below.

The insert 2 is screwed by means of the two L-shaped sections 2.1 and 2.2 to the tray-like component 1. For this purpose the two L-shaped sections 2.1 and 2.2 are each provided with two holes 2.1.1 and 2.2.1 respectively.

The two L-shaped sections are pushed with their flanks into corresponding grooves 2.11.2 and 2.11.3 in the end connecting elements 2.11 and 2.10 respectively. Whereas the two flanks of the L-shaped sections 2.1 and 2.2 enclose an angle of 90°, the grooves 2.11.2 and 2.11.3 are oriented with respect to the horizontal in such a way that they enclose an angle $\alpha$ which is somewhat greater than 90°. If during assembly the insert 2 is disposed in the tray-like component 1, then the two flanks of the two L-shaped sections 2.1, 2.2 which come into contact with the base part 1.2 are not aligned parallel with the base part but form a small angle with the base part. The screwing of the two L-shaped sections to the base part 1.2 presses the two flanks of the L-shaped sections onto the base part 1.2, so that a defined bending moment is produced, resulting in connection of the insert to the tray-like component by friction and by positive locking, thus precisely securing the position of the insert 2 in the tray-like component and of the individual parts of the insert relative to one another.

It can be seen from FIG. 1 that the longitudinal profiled sections and the connecting elements disposed transversely with respect thereto form a support surface for the bulk material which is distinguished by a plurality of box-like compartments which are open at the top. During operation of the ventilating elements bulk material will collect in these compartments and thereby form a natural wear protection layer.

The individual parts of the insert described above are merely pushed together so that they are then screwed as a unit to the tray-like component. However, within the scope of the invention it would be conceivable for the individual parts to be fitted and to be attached by means of welding in the region of the end connecting elements.

In the tests on which the invention is based it has been shown that the costs of producing the ventilation elements by pushing the individual parts together and then attaching them at the joints can be reduced by up to 30%. For variant described in detail above, in which welding is omitted, the cost savings even amount to 40%.

What is claimed is:

1. Ventilation element for a cooler for cooling bulk material, comprising a tray-like component (1) provided with at least one opening (1.10) for the supply of cooling gas as well as an insert (2) which can be releasably fixed in the tray-like component and forms a support surface which can be ventilated from below for the bulk material, the insert consisting of a plurality of longitudinal profiled sections and connecting elements disposed transversely with respect thereto, characterised in that the longitudinal profiled sections (2.1–2.7) and the connecting elements (2.8–2.11) are constructed so that they can be pushed into one another during assembly of the insert.

2. Ventilation element as claimed in claim 1, characterised in that the connecting elements (2.8–2.11) have grooves and/or recesses which are adapted to the cross-sectional profiles of the longitudinal profiled sections (2.1–2.7).

3. Ventilation element as claimed in claim 1, characterised in that the longitudinal profiled sections (2.1–2.7) have grooves and/or stops in order to position at least some of the connecting elements (2.8–2.11).

4. Ventilation element as claimed in claim 1, characterised in that the individual elements of the insert (2) are merely pushed on during assembly and the insert is releasably connected, preferably screwed, to the tray-like component (1).

5. Ventilation element as claimed in claim 1, characterised in that the individual elements (2.1–2.11) of the insert are merely pushed on during assembly and the insert (2) is connected to the tray-like component (1) by friction and by positive locking in such a way that a defined bending moment is produced, resulting in precise securing of the position of the insert in the tray-like components and of the individual parts of the insert relative to one another.

6. Ventilation element as claimed in claim 1, characterised in that at least some of the longitudinal profiled sections (2.1–2.7) are constructed as U-shaped sections and are disposed in such a way that a U-shaped section which is open at the top alternates with a U-shaped section which is open at the bottom, whereby the flanks of adjacent U-shaped sections engage in one another and form a ventilation slot between them.

7. Ventilation element as claimed in claim 1, characterised in that the support surface for the bulk material is formed by a plurality of box-like compartments which are open at the top and are constructed to receive bulk material.

8. Ventilation element as claimed in claim 1, characterised in that the insert consists of shaped sheet metal sections.

* * * * *